US008287205B2

(12) United States Patent
Desjarlais et al.

(10) Patent No.: US 8,287,205 B2
(45) Date of Patent: Oct. 16, 2012

(54) METHOD FOR BINDING A BOOK WITH A HELICAL PLASTIC COIL

(75) Inventors: Matthew G. Desjarlais, Winnipeg (CA); Walter D. Klassen, Winnipeg (CA)

(73) Assignee: Gateway Bookbinding Systems Ltd., Winnipeg, Manitoba (CA)

( * ) Notice: Subject to any disclaimer, the term of this patent is extended or adjusted under 35 U.S.C. 154(b) by 859 days.

(21) Appl. No.: 12/198,552

(22) Filed: Aug. 26, 2008

(65) Prior Publication Data

US 2009/0058068 A1 Mar. 5, 2009

Related U.S. Application Data

(60) Provisional application No. 60/969,771, filed on Sep. 4, 2007.

(51) Int. Cl.

| | |
|---|---|
| ***B42D 1/00*** | (2006.01) |
| ***B42D 5/00*** | (2006.01) |
| ***B42D 15/00*** | (2006.01) |
| ***B42F 13/00*** | (2006.01) |
| ***B42F 3/06*** | (2006.01) |
| ***B42F 13/04*** | (2006.01) |
| ***B42C 9/00*** | (2006.01) |
| ***B42B 5/08*** | (2006.01) |
| ***B42B 5/00*** | (2006.01) |
| ***B42B 5/06*** | (2006.01) |
| ***B42B 5/10*** | (2006.01) |
| ***B42B 9/00*** | (2006.01) |

(52) U.S. Cl. ..... 402/57; 281/15.1; 283/63.1; 402/80 P; 412/6; 412/7; 412/33; 412/34; 412/38; 412/39; 412/40

(58) Field of Classification Search ..... 281/15.1, 281/21.1, 51; 283/63.1, 117; 402/57, 80 P, 402/80 R; 412/1, 6, 7, 9, 16, 33, 34, 38, 412/39, 40

See application file for complete search history.

(56) References Cited

U.S. PATENT DOCUMENTS

| | | | | |
|---|---|---|---|---|
| 5,417,508 | A * | 5/1995 | Friedman | 402/57 |
| 5,931,623 | A * | 8/1999 | Hastings et al. | 412/39 |
| 6,000,897 | A | 12/1999 | Desjarlais | |
| 6,045,285 | A * | 4/2000 | Friedman | 402/57 |
| 6,382,950 | B1 | 5/2002 | DesJarlais et al. | |
| 7,246,982 | B2 | 7/2007 | Desjarlais et al. | |
| 2002/0129865 | A1 * | 9/2002 | Mori et al. | 140/92.9 |

* cited by examiner

*Primary Examiner* — Dana Ross
*Assistant Examiner* — Justin V Lewis
(74) *Attorney, Agent, or Firm* — Adrian D. Battison; Ade & Company Inc.

(57) ABSTRACT

A helical plastic coil is used for binding a collated book having a stack of pages with aligned holes along one edge of the book where a leading end of the filament is fed into a first hole at a first end of the book and the coil is rotated about its axis such that the leading end is threaded through the holes by entering each of the holes until the coil is threaded through all of the holes. The leading end of the coil is sheared by an anvil and blade so as to define a leading apex and a leading surface inclined rearwardly from the leading apex along the filament and across the filament. The leading apex is arranged such that, as the leading end enters each of the holes in turn, the leading apex is located on the leading end of the filament at a position thereon facing away from the trailing end of the coil and spaced from the end of the hole facing the first end of the book.

12 Claims, 6 Drawing Sheets

METHOD FOR BINDING A BOOK WITH A HELICAL PLASTIC COIL

This application claims the benefit under 35 U.S.C. 119 of Provisional Application 60/969,771 filed Sep. 4, 2007.

This invention relates to helical coils of a plastics material for insertion into the aligned holes at the edge of a collated book for binding the book.

BACKGROUND OF THE INVENTION

It is well known that collated books are often bound using a helical coil which passes through aligned holes at one edge of the book. This provides a book which can be easily opened and held at an opened position and is therefore particularly effective for manuals and reference materials.

The helical coil at the edge of the book can be formed from a coiled wire or a coiled strip of plastic material. Coiled wire has the significant advantage that it can be more easily inserted. Helical plastic coil has the advantages that it can be manufactured in different colours and therefore provides a particularly attractive appearance as opposed to the strictly utilitarian appearance of the steel wire.

Helical coils are produced by rotating the plastic material on a mandrel. The material is heated in order to adopt the diameter and pitch achieved by the mandrel. Mandrels are commonly an elongate rod which has a stationary coil guide that guides the material along the rod such that the material adopts the pitch of the coil guide and the diameter of the rod.

After forming the coils are inserted into the aligned holes at the edge of a collated book for binding the book. This can be carried out manually where the operator has control over the book and the coil to ensure proper insertion. However such manual processes are relatively slow and therefore expensive.

In U.S. Pat. No. 6,000,897 of Desjarlais issued Dec. 14, 1999 is disclosed a machine for inserting a plastic coil into aligned holes at the edge of a book for binding of the book.

Also in U.S. Pat. No. 7,246,982 of Desjarlais and Klassen issued Jul. 24, 2007 is disclosed a number of operating improvements to this machine.

This machine has achieved considerable commercial success and has operated successfully in the insertion of plastic coils automatically.

Also in U.S. Pat. No. 6,382,950 of Desjarlais and Klassen issued May 7, 2002 is disclosed a machine for winding the helical coil.

The disclosures of each of the above three patents are incorporated herein by reference or should be reviewed for further information concerning the techniques for manufacturing and inserting plastics coil of the type with which the present invention is concerned.

One of the issues with the use of coils formed from plastics material is that if the increased difficulty of insertion into the book relative to that of metal wire. This still leaves to some resistance amongst users to the use of such plastics coil despite the increased attractiveness of the product.

SUMMARY OF THE INVENTION

It is one object of the present invention to provide a method for insertion of a plastics coil and a plastics coil which are arranged to enable the insertion to be effected more easily.

According to a first aspect of the present invention there is provided a method for binding a book comprising:

forming a collated book having a stack of overlying aligned pages with aligned holes in the pages arranged along one edge of the book;

providing a helical coil arranged with a length along an axis of the coil to extend along the edge of the book and arranged with a required pitch of the coil such that respective turns of the coil pass through respective ones of the holes;

the coil being formed from a length of a filament of plastics material so as to define at a leading end of the coil a leading end of the filament, which is generally transverse to a longitudinal axis of the filament, and a peripheral surface surrounding the filament;

arranging the coil to locate the leading end of the coil at a first end of the edge of the book;

and driving the coil in rotation about its axis such that the leading end of the coil enters a first of the holes at the first end of the book and is threaded through the holes in the book by entering in turn each of the holes until the coil is threaded through all of the holes;

each of the holes having a first end of the hole which is that end of the hole closest to the first end of the book, a second end of the hole opposite the first end and two sides;

wherein the leading end of the coil is formed so as to define a leading apex and a leading surface inclined rearwardly from the leading apex along the filament and across the filament to the peripheral surface of the filament;

and wherein the leading apex is arranged on the leading end such that, as the leading end enters each of the holes in turn, the leading apex is located on the leading end of the filament at a position thereon spaced from the first end of the hole and the surface extends from the leading apex toward the first end of the hole.

This arrangement of the leading end of the coil by which the leading apex is positioned at a location spaced away from the first end of the hole is contrary to conventional practice and contrary to what would normally be obtained by a conventional cutting action and is surprisingly effective at enhancing the entry of the leading end into the holes. This improvement in the entry of the leading end into each hole significantly reduces the occurrence of jambs in coil insertion. Such jambs must be cleared manually thus requiring increased action by the operator and reducing the productivity of the coil insertion machine.

Preferably the leading end of the filament is cut at an angle across the filament so as to form the leading apex at the peripheral surface of the filament at one side thereof and the leading surface extends across the filament to the peripheral surface at a position opposite the leading apex.

In this case, preferably the leading apex is located on the leading end of the filament at a position opposite to the first end of the hole.

As an alternative however the leading apex can be located at a position on the leading end of the filament which is spaced from the peripheral surface of the filament. This can be obtained by cutting the leading end twice in two planes at an angle to each other to form the apex therebetween.

Preferably the leading end of the filament is cut by a shearing action to form the leading apex and the leading surface. This is preferably done in a single cutting action to form a single plane across the filament.

Preferably the leading end is cut by the shearing action in a direction passing across the leading end along a diagonal line extending through the leading apex.

Preferably the angle of the leading surface across the filament from the leading apex relative to a line along the peripheral surface of the filament parallel to the axis at the leading apex is less than 45 degrees. An angle less than 45 degrees gives a sharper apex and a leading plane at a sharper angle to the axis of the filament, but it will be appreciated that cutting at angles significantly less than 45 degrees become increasingly difficult.

According to a second aspect of the invention there is provided a helical coil for use in binding a book comprising:

a helical coil formed from a length of a filament of plastics material so as to define a leading end of the filament, which is generally transverse to a longitudinal axis of the filament, and a peripheral surface surrounding the filament, the coil having a length along an axis of the coil to extend along the edge of the book from a leading end of the coil adjacent one of the book to a trailing end of the coil adjacent an opposed end of the book;

the coil having a leading end of the filament at a leading end of the coil for insertion first into the holes by rotation about its axis such that the leading end of the filament enters a first of the holes at the first end of the book and is threaded through the holes in the book by entering in turn each of the holes until the coil is threaded through all of the holes with a trailing end of the coil;

wherein the leading end of the filament is formed so as to define a leading apex and a leading surface across the filament which is inclined rearwardly from the leading apex in a direction rearwardly along the axis of the filament and transversely across the filament to the peripheral surface of the filament;

and wherein the leading apex is located on the leading end of the filament at a position on the leading end spaced from a part of the periphery of the filament which is facing the trailing end of the coil.

According to a third aspect of the invention there is provided a method for forming a coil for use in binding a book comprising:

supplying a length of filament of a plastics material having an axis along its length and a peripheral surface;

forming the filament into a helical coil by wrapping the filament around an axis of the coil;

and cutting the coil into portions by shearing the filament as the coil is formed and forwarded along its axis by rotation around its axis;

wherein the filament is cut at an angle across the filament so as to form a leading apex at the peripheral surface of the filament at one side thereof and a leading surface which extends across the filament and is inclined rearwardly from the leading apex in a direction rearwardly along the axis of the filament and transversely across the filament to the peripheral surface of the filament at a position on the peripheral surface opposite the leading apex;

and wherein the leading end of the filament is cut so that the leading apex is located on the leading end of the filament at a position on the leading end spaced from a part of the periphery of the filament which is facing the trailing end of the coil.

Preferably the leading end is cut by the shearing action passing across the leading end along a diagonal line extending through the leading apex.

Preferably the filament is cut by a blade and anvil wherein the anvil includes a hole through which the filament is threaded and through which the filament passes as the coil is forwarded by rotation around the axis of the coil.

Preferably the leading end is cut by the shearing action passing across the leading end along a diagonal line extending through the leading apex and wherein the filament is cut by a blade and anvil wherein the anvil includes a hole through which the filament is threaded and through which the filament passes as the coil is forwarded by rotation around the axis of the coil.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Details of the machines for forming the coils and for insertion of the coils are shown in the above three patents the disclosure of which is incorporated by reference so that those details will not be repeated here.

Figure 1:
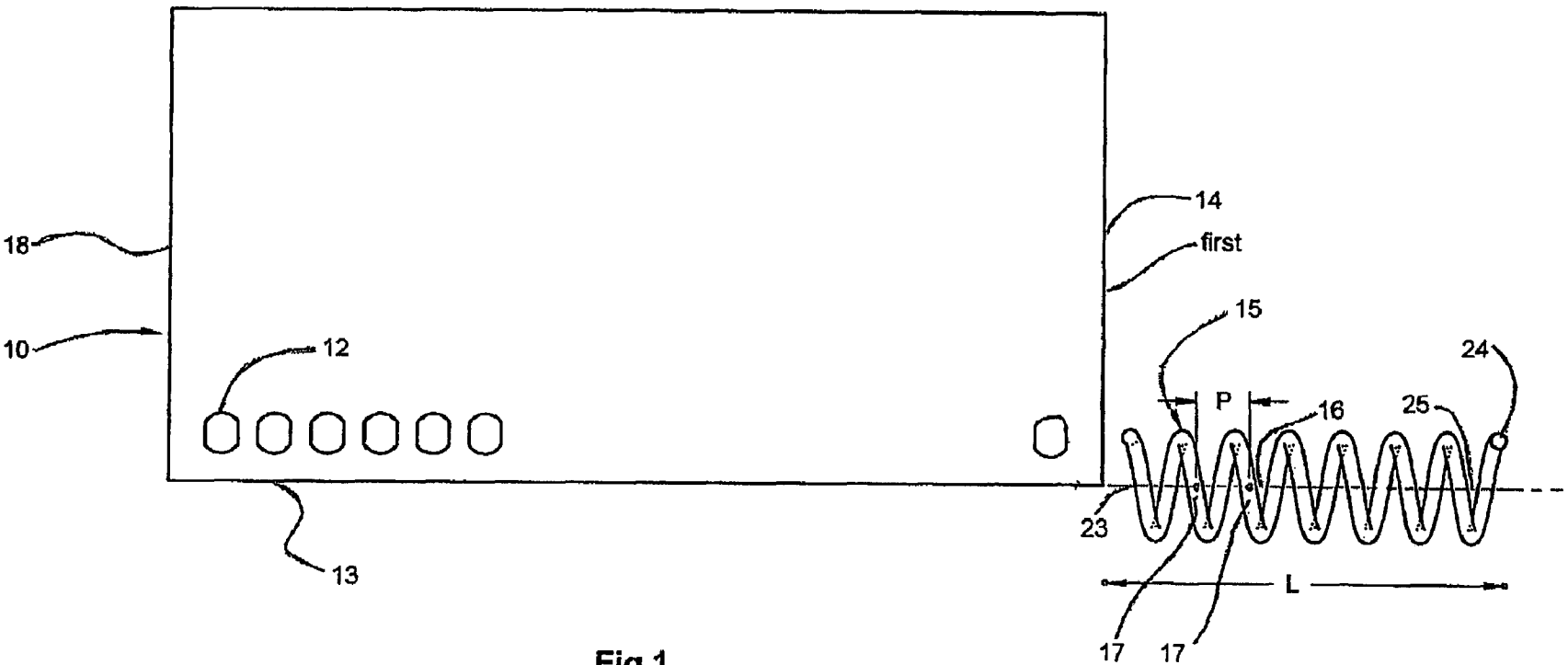
FIG. 1 is plan view of a book to be bound with a coil located for insertion into the aligned holes at the edge of the book for binding.
Figure 2:
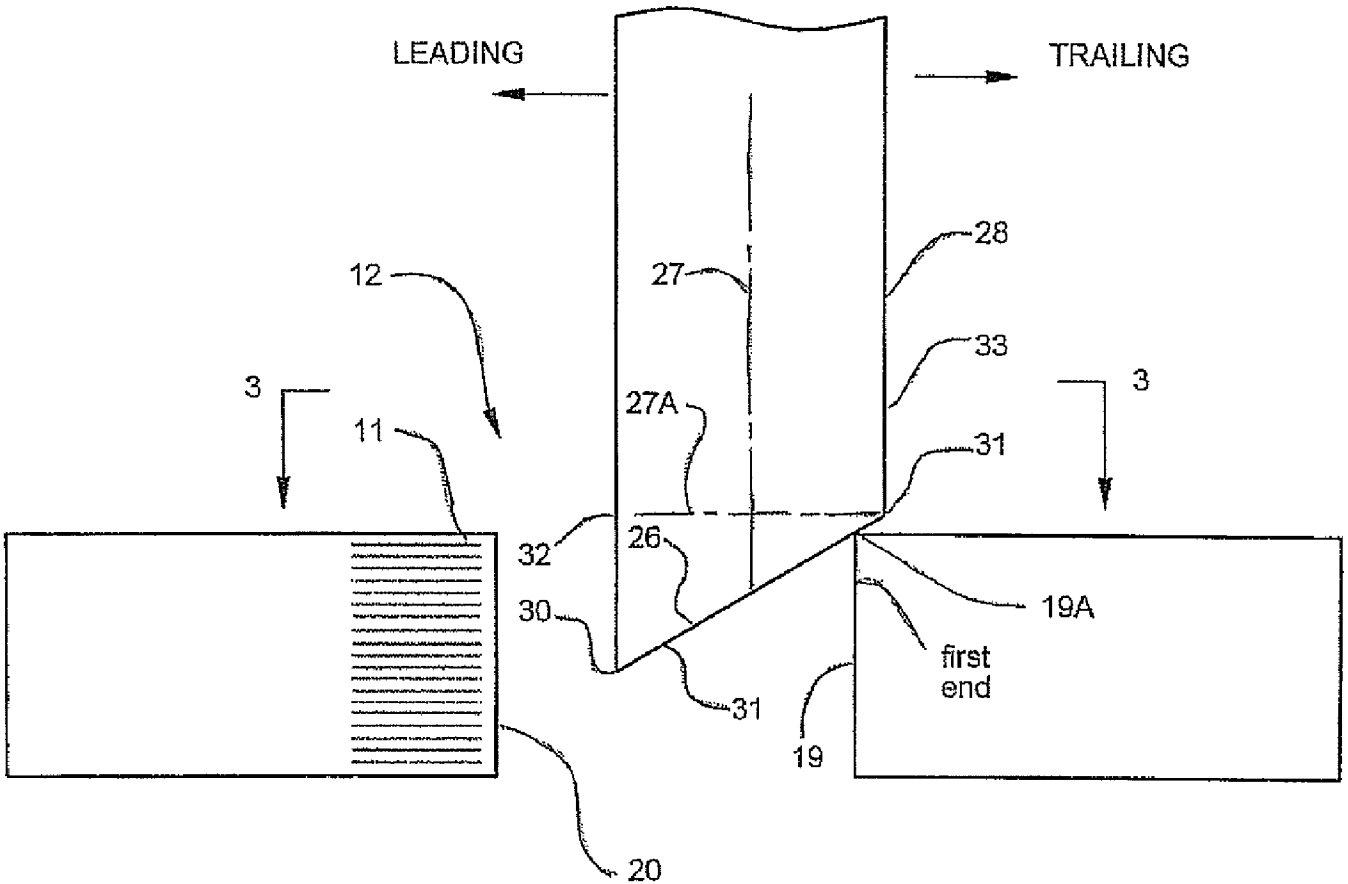
FIG. 2 is a cross sectional view through the first hole showing the leading end of the coil entering the hole.

In FIG. 1 is shown a collated book 10 having a stack of overlying aligned pages 11, shown in the cross-section of FIG. 2, with aligned holes 12 in the pages arranged along or adjacent one edge 13 of the book.

A helical coil 15 is arranged with a length L along an axis 16 of the coil to extend along the edge 13 of the book and arranged with a required pitch P of the coil between the turns 17 such that respective turns 17 of the coil pass through respective ones of the holes 12. The book has a first end 14 where the threading of the coil starts and a second end 18 opposite the first end with the length between the ends being approximately equal to the length of the coil.

The holes 12 as best shown in FIG. 2 include a first end 19 facing the first end of the book and a second end 20 facing the second end of the book. Holes of various shapes can be used from rectangular holes as shown, where the holes have sides 21 and 22, to circular holes where the holes of course have no specific sides but have the ends 19 and 20 at diametrically opposed locations n the hole. Rectangular hoes with rounded corners are typically used for improved coil insertion.

The coil is formed from a length of a filament of plastics material which is a thermoplastic material so that the coil is heat set to the helical shape. The coil has a leading end 23 and a trailing end 24 spaced by the length L. The coil has a coil axis 25 around which it is helically wound. The coil is arranged to be threaded into the holes with the leading end first. The coil is sheared or cut to form a leading end 26 of the filament across the axis of the filament and extending across the peripheral surface 29.

In the embodiment shown the leading end 26 forms a plane across the filament and the leading end of the coil is formed so as to define a leading apex 30 and a leading surface 30A inclined rearwardly from the leading apex along the filament and across the filament to an opposed location 31 on the peripheral surface of the filament. The leading apex 30 is a tip at the peripheral surface where the edge of the leading plane 26 meets the peripheral surface 29. The leading apex 30 is arranged on the leading end 26 on the side 32 of the filament which is facing along the axis of the coil in the leading direction and diametrically opposed to the side 33 of the filament which is facing in the trailing direction. In this way, as the leading end enters each of the holes in turn, the leading apex 30 is located at a position spaced from the first end 19 of the hole and the surface 26 extends from the leading apex toward the first end 19 of the hole.

Figure 3:
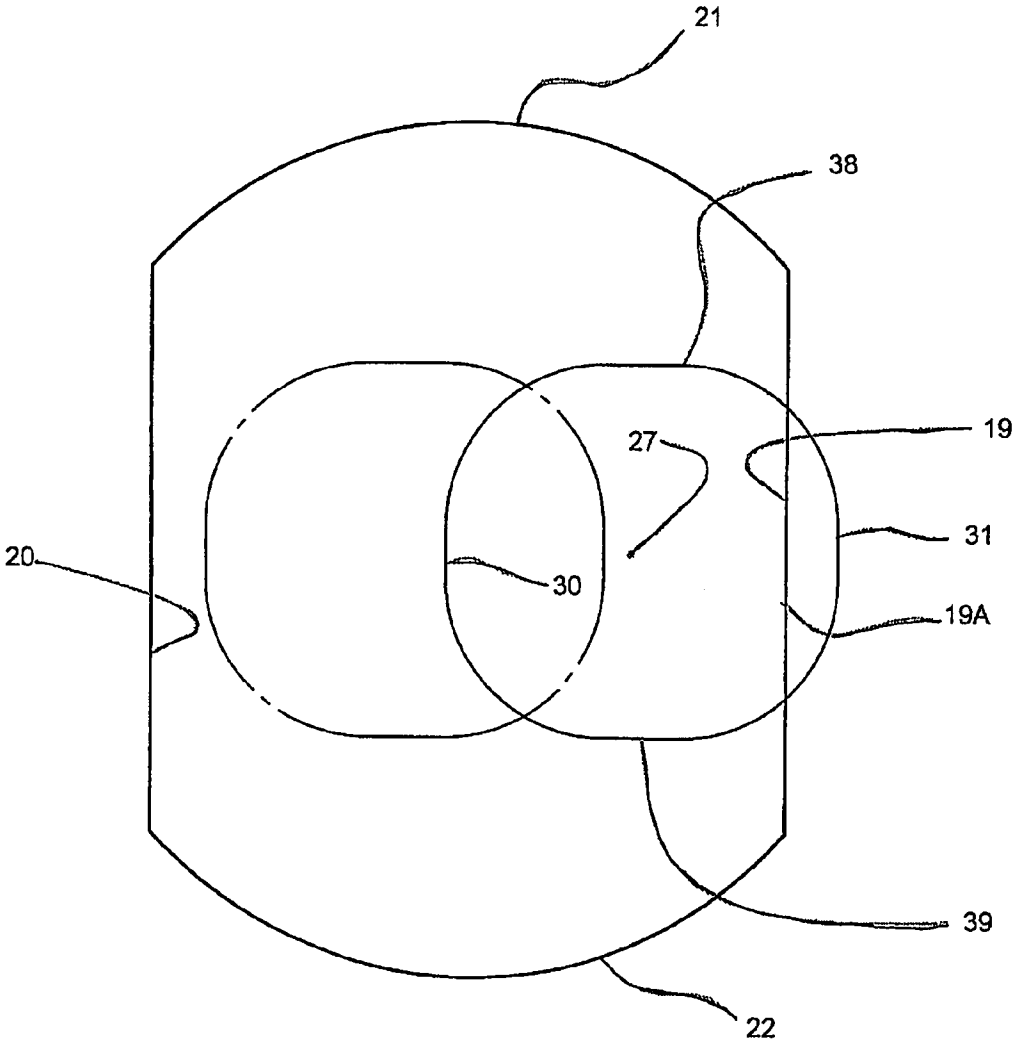
FIG. 3 is a view along the lines 3-3 of FIG. 2.

It has been found, as shown in FIGS. 2 and 3, that there is a tendency of the coil to enter the hole with the coil closer to or impacting with the first side 19 of the hole and spaced from the second end 20. In an arrangement where the leading surface is in a radial plane 27A of the axis 27 of the filament, there is a tendency of the filament to bind on the edge 19A of the hole at the side 19.

It has also been found that filaments cut using typical cutting equipment in a coil forming machine have the leading end cut so that the end plane 26 lies across the axis with a leading apex at the side 33 of the filament. It will be appreciated that the formation of the leading end with the apex 30 at the side 32 assists in allowing the apex to enter the hole and the inclined surface 26 to slide into the hole even if initially offset from the hole so that the surface engages the edge 19A.

The coil is threaded into the holes by driving the coil in rotation about its axis 25 such that the leading end of the coil enters a first of the holes 12 at the first end 14 of the book and is threaded through the holes in the book by entering in turn each of the holes until the coil is threaded through all of the holes.

As shown the leading apex is located on the leading end of the filament at a position opposite to the first end of the hole. However it will be appreciated that the leading apex may be angularly offset from this position even as much as 90 degrees while still allowing the leading apex to enter the hole and the inclined surface to follow that leading apex where the filament is offset partially beyond the edge 19A.

Impact of the inclined surface 26 with the edge 19A will cause the filament to move along the hole toward the end 20 and thus to enter without binding or jamming.

Figure 4:
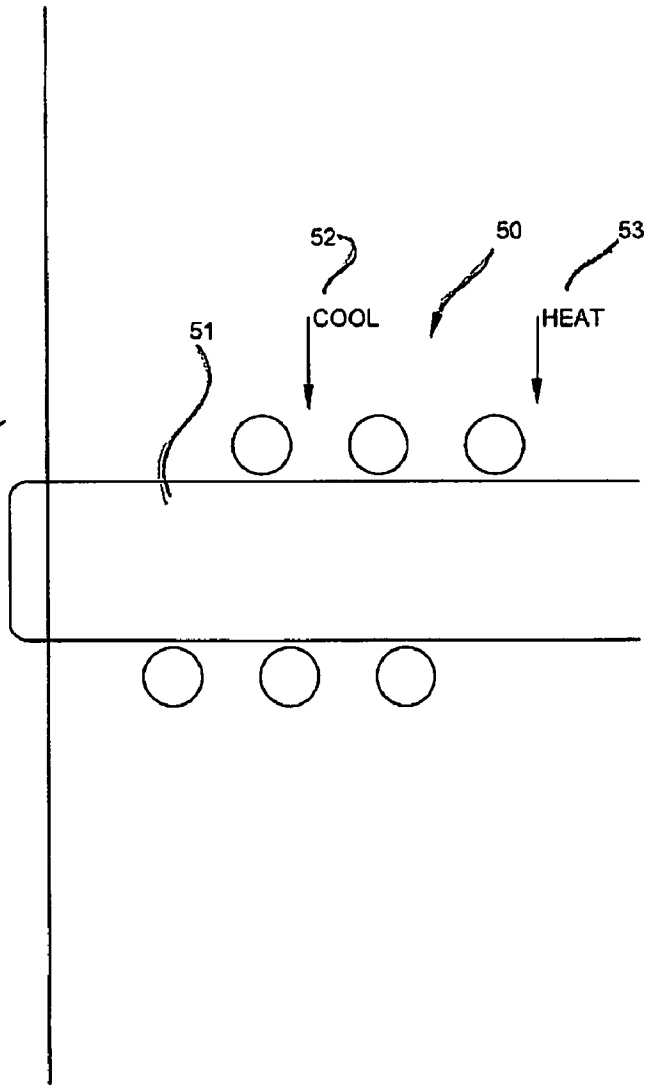
FIG. 4 is a plan view of a machine for forming the coil shown partly schematically and including the shearing anvil and blade for cutting the leading end.
Figure 4:
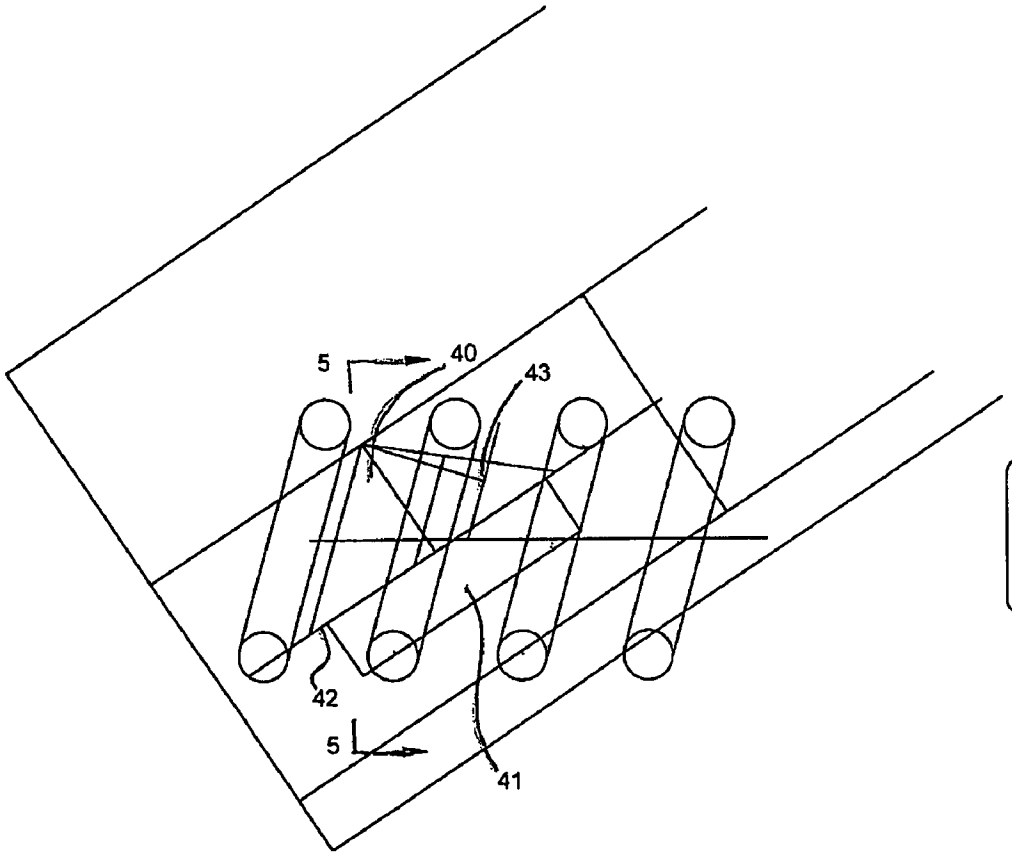
Figure 5:
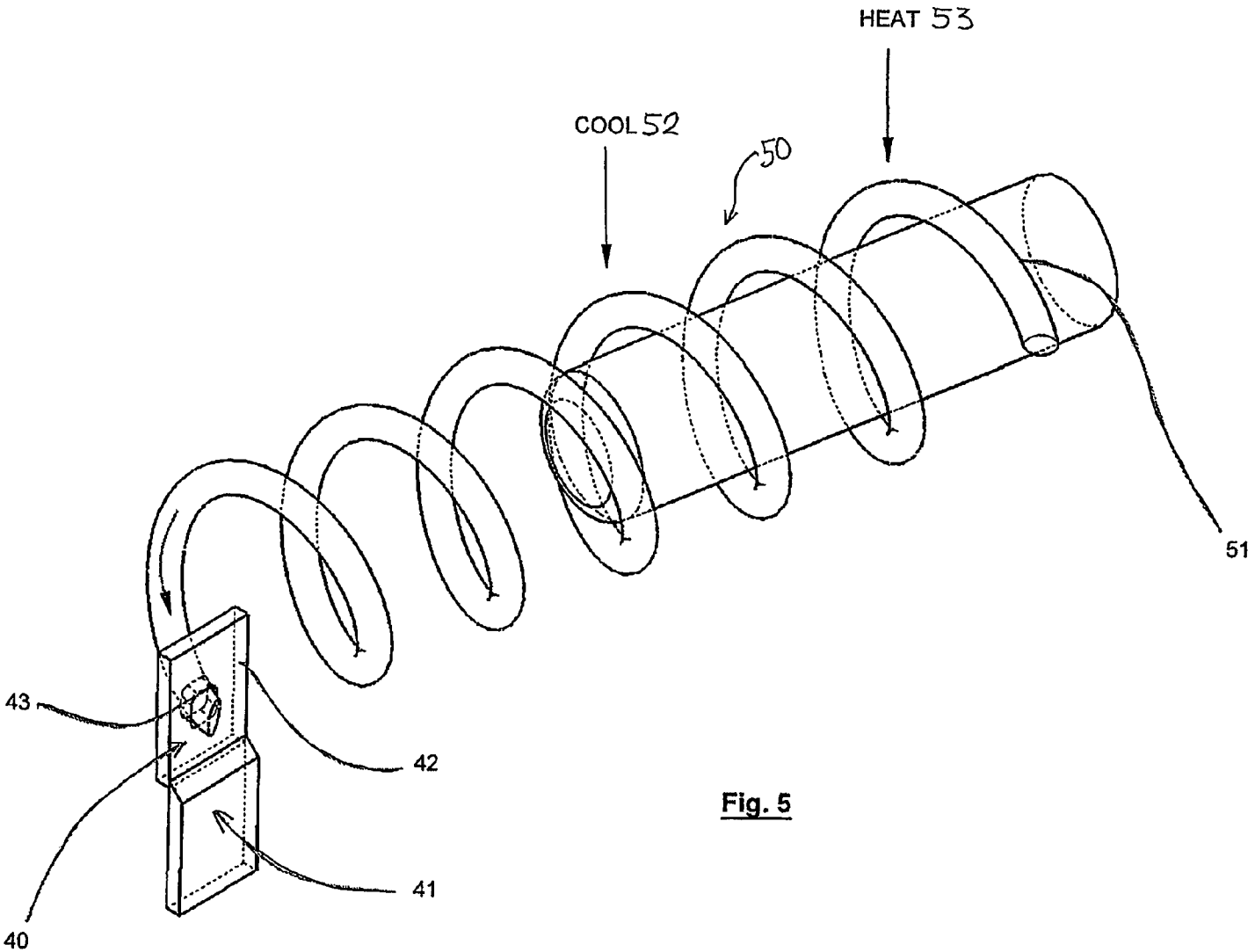
FIG. 5 is a view along the lines 5-5 of FIG. 4.

Turning now to FIGS. 4 and 5, there is shown one possible method for forming the coil with the leading apex 30 and the leading surface as shown and described above. In this method, the leading end of the filament is cut by a shearing action caused between an anvil 40 and a blade 41 sliding across an anvil surface 42 of the anvil to form the leading apex and the leading surface.

The coil is formed in a conventional forming system schematically indicated at 50 which includes a mandrel 51 with a helical guide to shape the filament when heated by a heating system 53 and when cooled to the formed shape by a cooling system 52.

The filament from the forming system is fed forwardly along its length so that it winds around the mandrel and forwards in the axial direction of the coil and passes through a guide hole 43 in the anvil 40 which remains fixed in place. The filament emerges through the anvil surface approximately at right angles to the surface 42. With the anvil surface 42 arranged at the angle to the filament previously described the leading end of the filament is cut at an angle across the filament at the required angle by the sliding action of the blade across the surface 42. The blade is arranged to move across the surface 42 in a direction across the filament from the leading apex 30 to the opposed position 31 so that the leading end is cut by the shearing action passing across the leading end along a diagonal line extending through the leading apex. This acts to form any burrs in the cuffing action, which occur when the blade has become a little dull, at the edge 31 rather than at the sides 38 and 39 (FIG. 3) at a position at 90 degree spacing from the leading apex. The cutting action can also be in the opposite direction to form the burr at the leading apex. The avoidance of burrs at the positions 38 and 39 also assists in allowing the leading end 26 to pass through the hole without binding.

The angle of the leading surface across the filament from the leading apex relative to the axis 27 at the leading apex is generally less than 45 degrees so as to form as sharp an angle as possible, bearing in mind that the twisting of the anvil 41 relative to the filament has limitations based on the practical thickness of the anvil.

The use of an anvil with a hole ensures that the filament remains controlled when the cutting action momentarily stops the movement of the filament. Thus the action of the blade in its cutting action closes off the hole temporarily and stops the downstream end of the filament. This causes the filament to back up slightly by slightly unwinding the helix until the blade is moved back to its retracted position allowing the filament to continue in its path through the ole in the anvil. The slight unwinding is counteracted by the spring in the coil so that the filament movement forwards through the hole speeds up slightly beyond the normal required rate so that the coil reverts to its helical shape until the next cutting action.

Figure 2A:
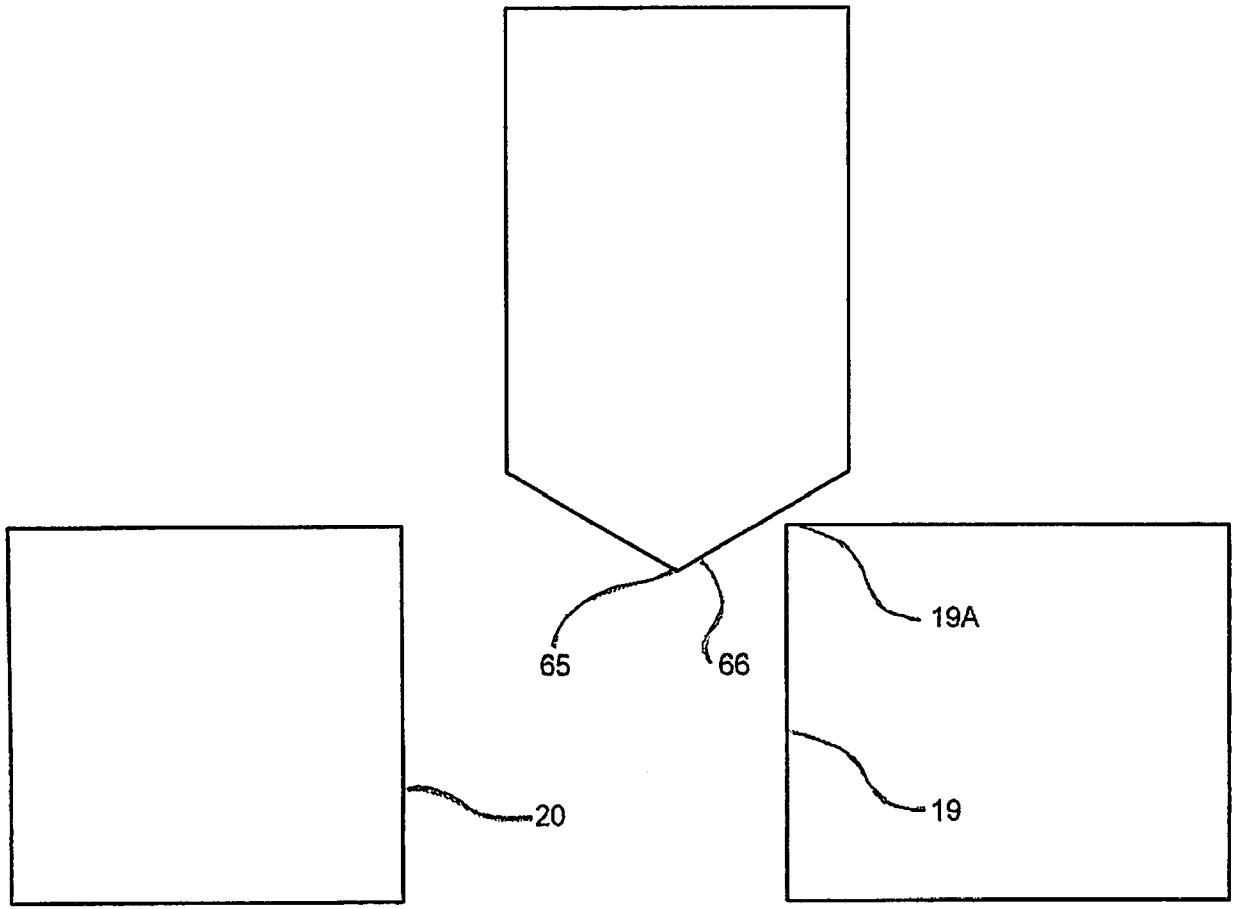
FIG. 2A is a cross sectional view similar to that of FIG. 2 but showing a modified leading end of the coil according to the present invention.

As an alternative shown in FIG. 2A, the filament may be cut in a double cutting action so that the leading apex 65 is part way across the filament end face as indicated defining a surface 66 which is inclined rearwardly across the filament end. This provides the same feeding action as the arrangement of FIG. 2 but the double cutting action is more difficult to achieve.

Since various modifications can be made in my invention as herein above described, and many apparently widely different embodiments of same made within the spirit and scope, it is intended that all matter contained in the accompanying specification shall be interpreted as illustrative only and not in a limiting sense.

The invention claimed is:

1. A method for binding a book comprising:

forming a collated book having a stack of overlying aligned pages with aligned holes in the pages arranged along one edge of the book;

providing a helical coil arranged with a length along an axis of the coil to extend along the edge of the book and arranged with a required pitch of the coil such that respective turns of the coil pass through respective ones of the holes;

the coil being formed from a length of a cylindrical filament of plastics material so as to define at a leading end of the filament a circular leading end surface of the filament, which is generally transverse to a longitudinal axis of the filament, and a cylindrical peripheral surface surrounding the filament;

arranging the coil to locate the leading end of the coil at a first end of the edge of the book;

and driving the coil in rotation about the axis of the coil such that the leading end of the coil enters a first of the holes at the first end of the book and is threaded through the holes in the book by entering in turn each of the holes until the coil is threaded through all of the holes;

each of the holes having a first end of the hole which is that end of the hole closest to the first end of the book, a second end of the hole opposite the first end and two sides;

wherein the leading end of the coil is formed so as to define a leading apex and said leading end surface inclined rearwardly from the leading apex along the filament and across the filament to the circular peripheral surface of the filament;

the circular leading end surface of the filament being cut at an angle different from 90 degrees to the longitudinal axis of the filament across the filament;

so as to form the leading apex of the leading end at the circular peripheral surface of the filament at one side of the circular end surface;

and so that the circular leading end surface extends across the filament from said leading apex at said circular peripheral surface at said one side to a diametrically opposed side of the circular peripheral surface;

and wherein the leading apex is arranged on the leading end such that, as the leading end enters each of the holes in turn, the leading apex is located on the leading end at a position thereon spaced from the first end of the hole and the circular leading end surface extends from the leading apex toward the first end of the hole.

2. The method according to claim 1 wherein the leading apex is located on the leading end of the filament at a position diametrically opposite to the first end of the hole.

3. The method according to claim 1 wherein the leading end of the filament is cut by a shearing action to form the leading apex and the circular leading end surface.

4. The method according to claim 1 wherein the angle of the circular leading end surface across the filament from the leading apex relative to a line along the cylindrical peripheral surface of the filament parallel to the axis at the leading apex is less than 45 degrees.

5. A helical coil for use in binding a book comprising:

a helical coil formed from a length of a cylindrical filament of plastics material so as to define a circular leading end surface of the filament, which is generally transverse to a longitudinal axis of the filament, and a cylindrical peripheral surface surrounding the filament;

the coil having a length along an axis of the coil to extend along the edge of the book from a leading end of the coil adjacent one end of the book to a trailing end of the coil adjacent an opposed end of the book;

the coil having a leading end of the filament at a leading end of the coil for insertion first into the holes by rotation about its axis such that the leading end of the filament enters a first of the holes at the first end of the book and is threaded through the holes in the book by entering in turn each of the holes until the coil is threaded through all of the holes with a trailing end of the coil;

wherein the leading end of the filament is formed so as to define a leading apex and said circular leading surface across the filament which is inclined rearwardly from the leading apex in a direction rearwardly along the axis of the filament and transversely across the filament to the cylindrical peripheral surface of the filament;

the circular leading end surface of the filament lying at an angle different from 90 degrees to the longitudinal axis of the filament across the filament;

so as to form the leading apex of the leading end at the cylindrical peripheral surface of the filament at one side of the circular end surface;

and so that the circular leading end surface extends across the filament from said leading apex at said cylindrical peripheral surface at said one side to a diametrically opposed side of the cylindrical peripheral surface;

and wherein the leading apex is located on the leading end of the filament at a position on the leading end spaced from a part of the cylindrical peripheral surface of the filament which is facing the trailing end of the coil.

6. The helical coil according to claim 5 wherein the leading apex is located on the leading end of the filament at a position opposite to said part of the cylindrical peripheral surface of the filament which is facing the trailing end of the coil.

7. The helical coil according to claim 5 wherein the angle of the circular leading end surface across the filament from the leading apex relative to a line along the cylindrical peripheral surface of the filament parallel to the axis at the leading apex is less than 45 degrees.

8. A method for forming a coil for use in binding a book comprising:

supplying a length of cylindrical filament of a plastics material having an axis of the filament along its length and a cylindrical peripheral surface;

forming the filament into a helical coil by wrapping the filament around an axis of the coil;

and cutting the coil into portions by a shearing action on the filament as the coil is formed and forwarded along the axis of the coil by rotation around the axis of the coil;

wherein the filament is cut at an angle across the filament so as to form a leading apex at the cylindrical peripheral surface of the filament located at one side of the cylindrical peripheral surface and a circular leading end surface which extends across the filament;

wherein the circular leading end surface is cut at an angle different from 90 degrees to the longitudinal axis of the filament so that the circular leading end surface is inclined rearwardly from the leading apex in a direction rearwardly along the axis of the filament and transversely across the filament to the cylindrical peripheral surface of the filament at a position on the cylindrical peripheral surface diametrically opposite the leading apex;

and wherein the leading end of the filament is cut so that the leading apex is located on the cylindrical peripheral surface of the filament at a position on the cylindrical peripheral surface spaced from a part of the cylindrical peripheral surface of the filament which is facing the trailing end of the coil.

9. The method according to claim 8 wherein the leading apex is located on the cylindrical peripheral surface of the filament at a position diametrically opposite to the part of the cylindrical peripheral surface of the filament which is facing the trailing end of the coil.

10. The method according to claim 8 wherein the leading end is cut by the shearing action passing across the leading end along a diagonal line extending through the leading apex.

11. The method according to claim 8 wherein the angle of the leading end surface across the filament from the leading apex relative to a line along the cylindrical peripheral surface of the filament parallel to the axis at the leading apex is less than 45 degrees.

12. The method according to claim 8 wherein the filament is cut by a blade and anvil wherein the anvil includes a hole through which the filament is threaded and through which the filament passes as the coil is forwarded by rotation of the coil around the axis of the coil.

* * * * *